US007921928B2

(12) United States Patent
Thompson et al.

(10) Patent No.: US 7,921,928 B2
(45) Date of Patent: Apr. 12, 2011

(54) 90 DEGREE DRY HORIZONTAL SIDEWALL SPRINKLER

(75) Inventors: Andrew T. Thompson, Hastings, MI (US); Scott T. Franson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 347 days.

(21) Appl. No.: 12/193,522

(22) Filed: Aug. 18, 2008

(65) Prior Publication Data

US 2010/0038099 A1 Feb. 18, 2010

(51) Int. Cl.
*A62C 37/08* (2006.01)

(52) U.S. Cl. ..... 169/37; 169/17; 169/41

(58) Field of Classification Search ..... 169/16, 169/17, 37, 38, 41, 90; 137/72, 79
See application file for complete search history.

(56) References Cited

U.S. PATENT DOCUMENTS

| | | | | | |
|---|---|---|---|---|---|
| 1,903,150 | A | | 3/1933 | Tyden | |
| 2,155,990 | A | | 4/1939 | Hodgman, Jr. | |
| 2,180,258 | A | | 11/1939 | Rowley | |
| 2,211,399 | A | | 8/1940 | Winslow | |
| 2,291,818 | A | | 8/1942 | Loepsinger | |
| 2,732,018 | A | | 1/1956 | Grimes | |
| 3,007,528 | A | | 11/1961 | Gloeckler | |
| 3,061,015 | A | | 10/1962 | Cann, Jr. | |
| 3,067,823 | A | | 12/1962 | Kavanagh | |
| 3,080,000 | A | | 3/1963 | Gloeckler | |
| 3,191,685 | A | * | 6/1965 | Warne | 169/90 |
| 3,584,689 | A | | 6/1971 | Willms | |
| 3,976,141 | A | * | 8/1976 | Harrington | 169/90 |
| 4,007,878 | A | | 2/1977 | Anderson | |
| 4,091,872 | A | | 5/1978 | Mountford | |
| 4,177,862 | A | | 12/1979 | Bray | |
| 4,191,257 | A | * | 3/1980 | Mohler | 169/90 |
| 4,220,208 | A | | 9/1980 | Jackson et al. | |
| 4,228,858 | A | | 10/1980 | Sclafani | |
| 4,258,795 | A | * | 3/1981 | Hansen | 137/79 |
| 4,417,626 | A | | 11/1983 | Hansen | |
| 4,923,013 | A | | 5/1990 | De Gennaro | |
| 4,964,574 | A | | 10/1990 | Daigle | |
| 5,188,185 | A | | 2/1993 | Mears | |
| 5,415,239 | A | | 5/1995 | Kotter et al. | |

(Continued)

OTHER PUBLICATIONS

The Viking Corporation, "Standard/Quick Response Extended Coverage Dry Horizontal Sidewall Sprinkler"; Form No. F_051598; Nov. 10, 2006 (6 pages).

(Continued)

*Primary Examiner* — Steven J Ganey

(74) *Attorney, Agent, or Firm* — Harness, Dickey & Pierce, P.L.C.

(57) ABSTRACT

A horizontal dry fire protection sprinkler includes a housing having a vertical segment and a horizontal segment extending generally perpendicular to the vertical segment. The vertical segment defines an inlet opening. A plug member is disposed in the inlet opening for sealingly closing the inlet opening. A sprinkler is attached to the horizontal segment and includes a base having a passage extending therethrough and defining an outlet opening. A cap is disposed in the outlet opening and a heat sensitive trigger engages the cap. A translation mechanism is disposed in the housing and engaging the cap and supporting the plug member in the inlet opening, wherein when the heat sensitive trigger releases support of the cap, the translation mechanism is allowed to move within said housing to allow the plug member to dislodge from the inlet opening.

21 Claims, 10 Drawing Sheets

U.S. PATENT DOCUMENTS

| | | | | |
|---|---|---|---|---|
| 5,647,438 | A | 7/1997 | Chatrathi et al. | |
| 5,775,431 | A | 7/1998 | Ondracek | |
| 5,967,240 | A | 10/1999 | Ondracek | |
| 7,143,834 | B2 * | 12/2006 | Dolan | 169/37 |
| 7,516,800 | B1 * | 4/2009 | Silva et al. | 169/37 |
| 2003/0075343 | A1 | 4/2003 | Ballard | |
| 2005/0121206 | A1 | 6/2005 | Dolan | |
| 2005/0173562 | A1 | 8/2005 | Franson et al. | |
| 2007/0187116 | A1 | 8/2007 | Jackson et al. | |
| 2008/0257564 | A1 * | 10/2008 | Cordell et al. | 169/17 |

OTHER PUBLICATIONS

The Viking Corporation, "Quick Response Fusible Element HSW Sprinklers VK307, VK334, and HP HP VK346"; Form No. F_020207; Jun. 1, 2007 (6 pages).

The Viking Corporation, "MicromaticO and MicromatichpO Standard Response Horizontal Sidewall Sprinklers"; Form No. F_123096; Oct. 12, 2007 (6 pages).

The Viking Corporation, "ESFR Dry Pendent Sprinkler VK501 (K14.0)"; Form No. F_050707; Apr. 18, 2008 (8 pages).

* cited by examiner

90 DEGREE DRY HORIZONTAL SIDEWALL SPRINKLER

FIELD

The present disclosure relates to automatically operated fire extinguishing systems used for buildings, and relates specifically to fire extinguishing systems of the dry type which normally exclude water from the sprinkler until a fire occurs in the vicinity of one or more sprinklers.

BACKGROUND

The statements in this section merely provide background information related to the present disclosure and may not constitute prior art.

Dry-type sprinklers for fire protection systems have been available for many years. The dry-type sprinklers can be installed in either an upright, a pendant or a horizontal position, according to design. Generally speaking, dry pipe sprinklers comprise a sprinkler adapted to be installed in a piping system, the sprinkler having a valve at the inlet end to prevent water or other fire extinguishing fluid in the pipeline from entering the sprinkler until the sprinkler is put into operation by collapse of a thermally responsive mechanism. The valve end of the sprinkler is screwed into or otherwise attached to a fitting in the water supply piping. This type of dry-pipe sprinkler is particularly useful for suppression or controlling a fire situation in a warehouse area that is generally controlled to maintain a temperature below freezing for the fire suppressant liquid. In many warehouse coolers and freezers, the compartment that is controlled at a cool or freezing temperature is a box enclosure within a heated warehouse or building compartment. The sprinkler system desired for control or suppression against fire is typically a wet pipe system that includes water or fire suppressant pressurized up to the sprinkler assembly for rapid discharge of fluid or gas at the time of operation of the heat sensitive sprinkler trigger assembly. The use of dry horizontal sidewall sprinklers in a cooler or freezer environment, is known, however, the assembly of the dry horizontal sidewall sprinklers is complicated as the water supply pipe is typically disposed above the cooler or freezer compartment and a series of drop-down fittings and pipes are required to connect the dry horizontal sidewall sprinkler to the water supply line.

SUMMARY

A horizontal dry fire protection sprinkler includes a housing having a vertical segment and a horizontal segment extending generally perpendicular to the vertical segment. The vertical segment defines an inlet opening. A plug member is disposed in the inlet opening for sealingly closing the inlet opening. A sprinkler is attached to the horizontal segment and includes a base having a passage extending therethrough and defining an outlet opening. A cap is disposed in the outlet opening and a heat sensitive trigger engages the cap. A translation mechanism is disposed in the housing and engaging the cap and supporting the plug member in the inlet opening, wherein when the heat sensitive trigger releases support of the cap, the translation mechanism is allowed to move within said housing to allow the plug member to dislodge from the inlet opening.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
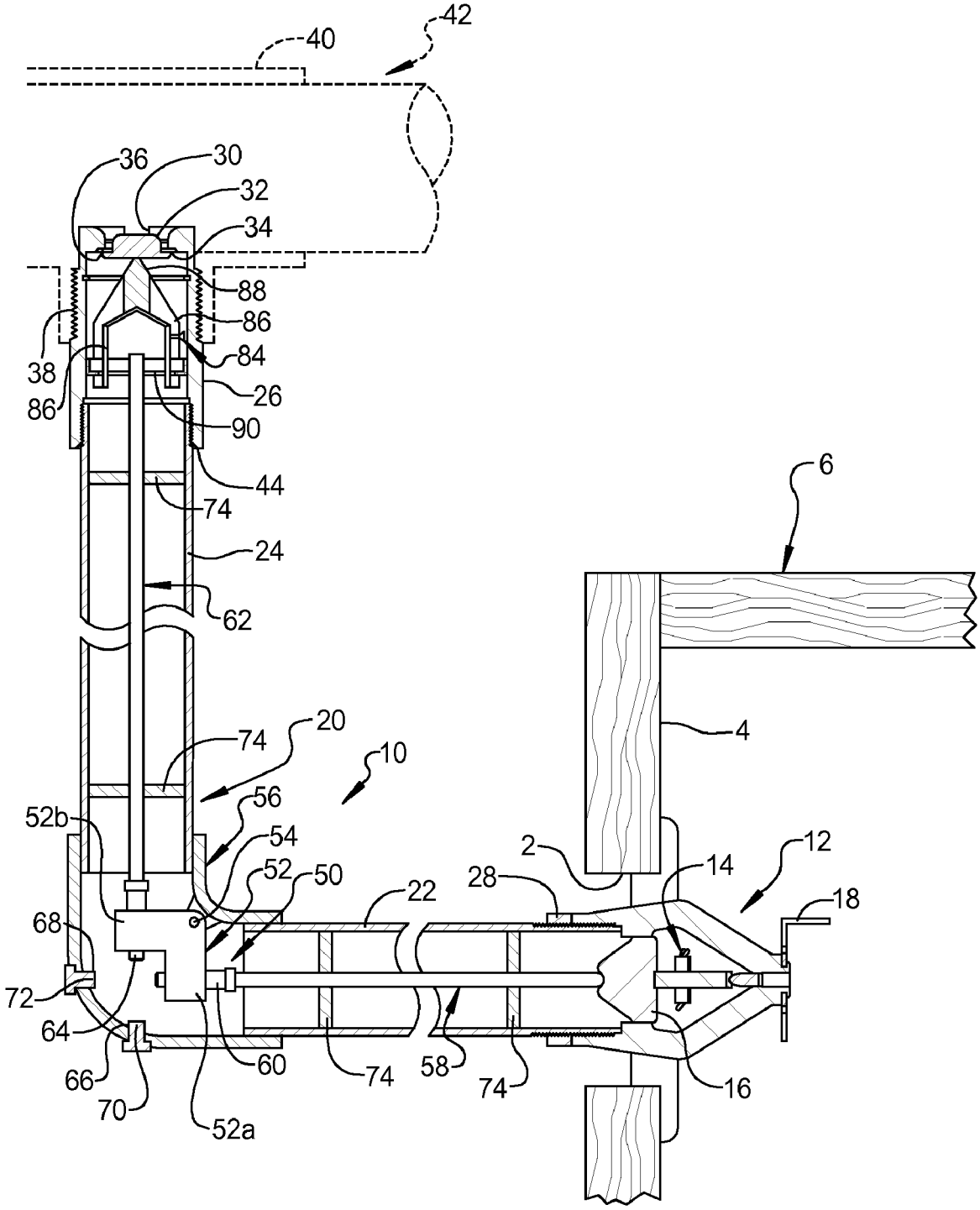
FIG. 1 is a cross-sectional view of a dry sprinkler assembly according to the principles of the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, a 90 degree dry-type horizontal sidewall sprinkler assembly 10, according to the principles of the present disclosure, will now be described. The sprinkler assembly 10 includes a sprinkler body 12 including a thermally responsive element 14 mounted thereto. The thermally responsive element 14 engages a support plug or pip cap 16. A deflector 18 is mounted to the sprinkler body 12. The sprinkler body 12 is mounted to an outer housing 20 which includes a horizontal segment 22 and a vertical segment 24. The sprinkler body 12 is mounted to the horizontal segment 22 and the vertical segment 24 can be attached to an inlet body 26. The horizontal segment 22 can extend through an opening 2 in a sidewall 4 of a cooler or freezer compartment 6. A lock nut 28 can be threadedly engaged with the horizontal segment 22 of the outer housing 20 and can be disposed against the sprinkler body 12.

Figures 10, 12:
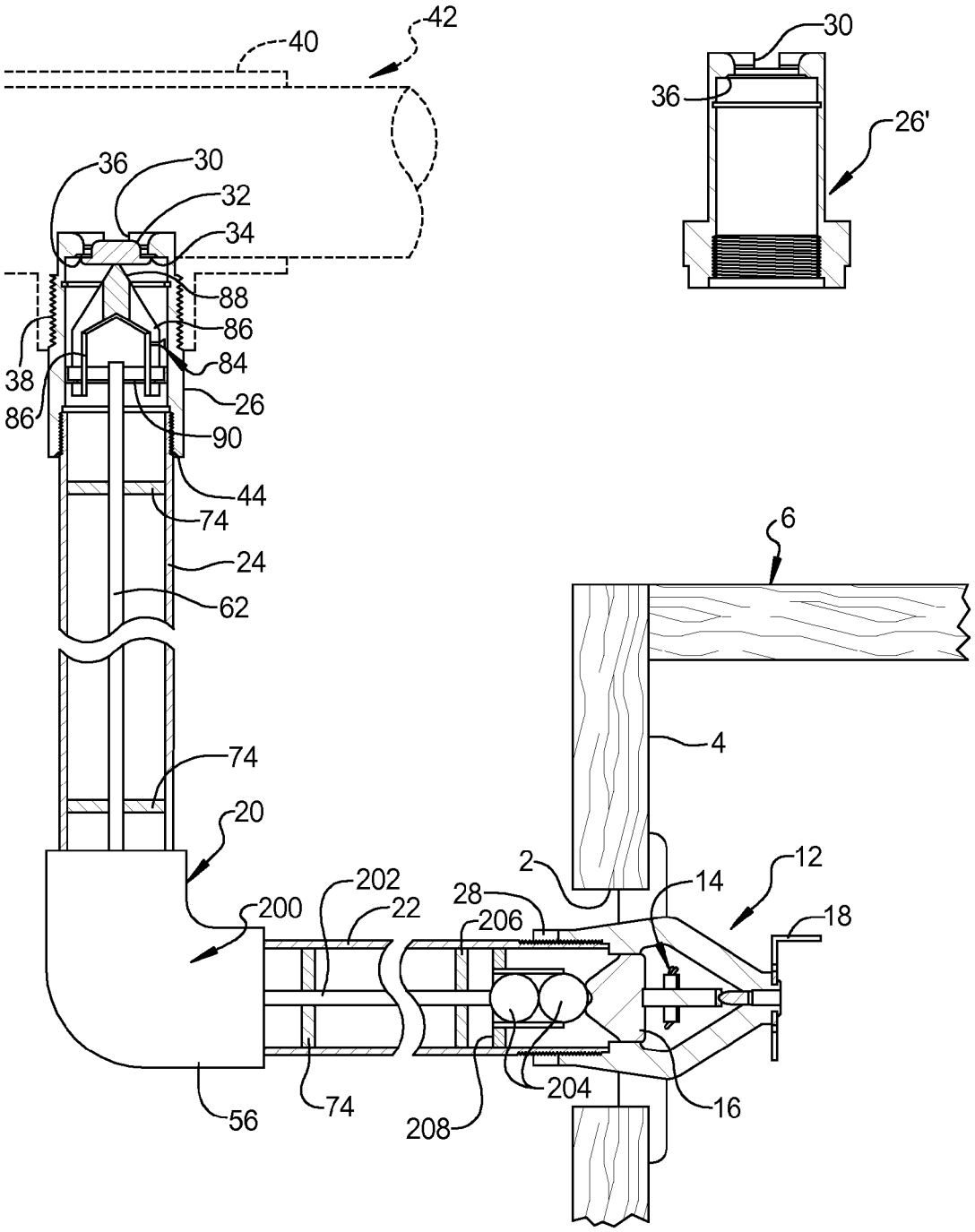
FIG. 10 is a cross-sectional view of a dry sprinkler assembly according to the principles of the present disclosure.
FIG. 12 is a cross-sectional view of an alternative inlet body with a grooved inlet connection for connection to a piping system according to the principles of the present disclosure.

The sprinkler assembly 10 includes an inlet opening 30 disposed in the inlet body 26 of the housing 20. A plug member 32 is disposed in the inlet opening 30 and can include a spring washer 34 that engages a plug seat 36 for sealingly closing the inlet opening 30. The inlet body 26 can be provided with a threaded exterior engagement portion 38 for threaded engagement with a fitting 40 of a piping system 42. Alternatively, as shown in FIG. 12, the inlet body 26' can be provided with a grooved inlet connection for connection to the piping system 42. The inlet body 26 can be formed integral with the housing, or can be otherwise connected such as by a threaded connection 44.

A translation mechanism 50 can be disposed in the housing for engaging the cap 16 and supporting the plug member 32 in the inlet opening 30. When the heat sensitive trigger 14 releases support of the cap 16, the translation mechanism 50 is allowed to move within the housing to allow the plug member 32 to dislodge from the inlet opening 30. The translation mechanism 50 can be in the form of any means that is capable of supporting the plug member 32 in the inlet opening 30 and releasing the plug member 32 from the inlet opening 30 upon the heat sensitive trigger 14 being released from engaging the cap 16 which is disposed at a generally 90 degree orientation relative to the vertical housing section 24 in which the inlet opening 30 is disposed. By way of non-limiting example, FIGS. 1-11 of the present application disclose various different translation mechanisms that transmit motion along the horizontal segment 22 to vertical motion that allow the release of the plug 32 from the inlet opening 30, in response to the release of the heat sensitive trigger 14.

With reference to FIG. 1, the translation mechanism 50 includes a pivot member 52 pivotally mounted to the housing 20. The pivot member 52 can include a pivot pin 54 that can be mounted to an elbow section 56 of the housing 20 and can include a first arm portion 52*a* and a second arm portion 52*b*. A horizontal link 58 can engage the first arm 52*a* of the pivot member 52 and can extend to engage directly or indirectly with the cap 16. The pivot member 52 can include a threaded adjustment device 60 that allows for tension adjustment of the translation mechanism 50. The threaded adjustment mechanism 60 can include a threaded fastener which threadedly engages a threaded aperture in the arm portion 52*a*. A vertical link 62 can engage the second arm 52*b* of the pivot member 52 and can support the plug member 32 in the inlet opening 30. The pivot member 52 can be provided with a second adjustment mechanism 64 that can include a threaded fastener 64 threadably engaged with the second arm 52*b* of the pivot member 52.

Figure 2:
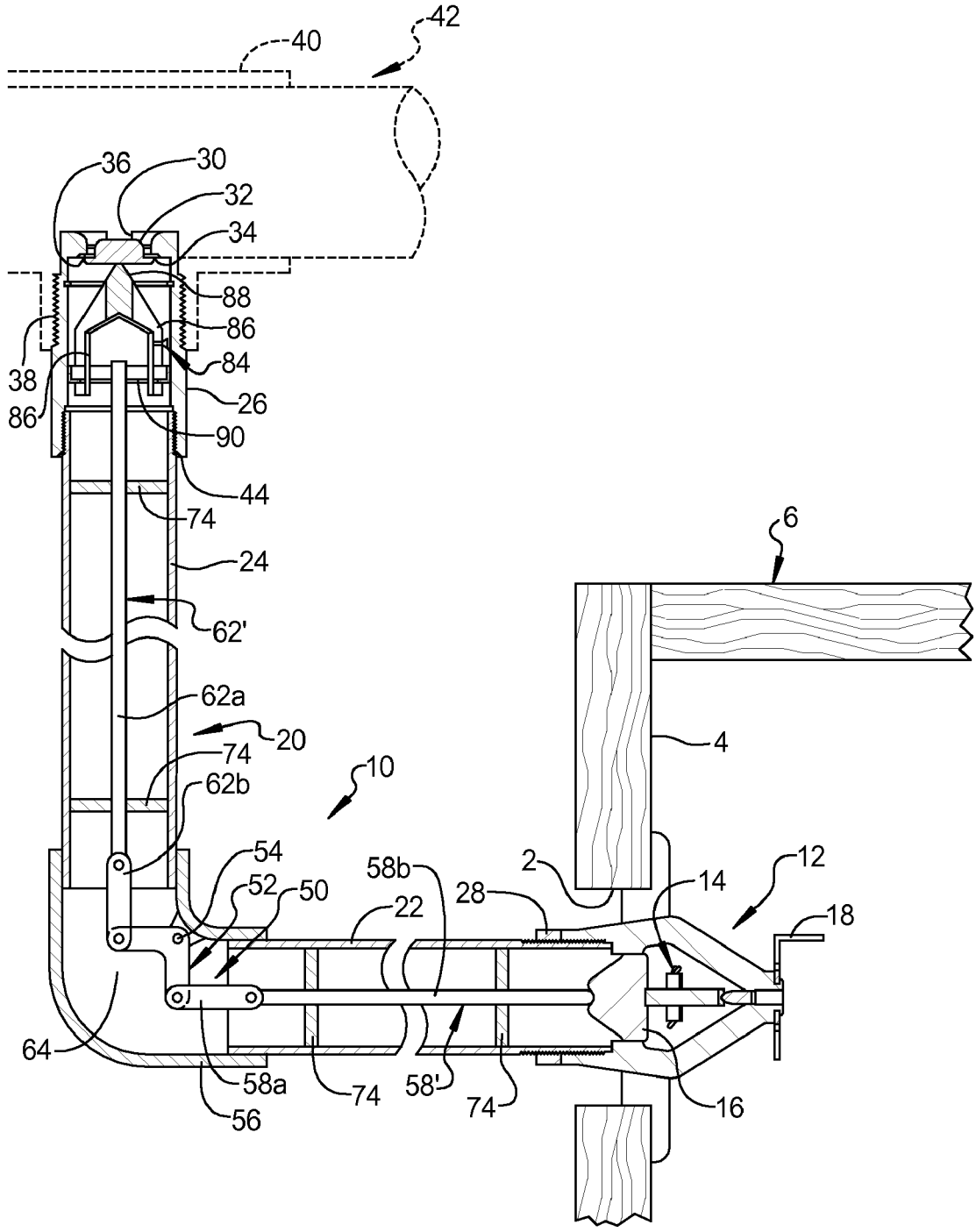
FIG. 2 is a cross-sectional view of a dry sprinkler assembly according to the principles of the present disclosure.

Access ports 66, 68 can be provided in the housing 20 to allow access to the adjustment members 60, 64. Plug members 70, 72 can be inserted in the access ports 66, 68, respectively, in order to sealingly close off the access ports 66, 68. The horizontal link 58 and vertical link 62 can each be in the form of an elongated rod which can include radially outwardly extending spokes 74 which engage the wall surface of the housing 20 to direct the links 58, 62 in a longitudinal direction in the horizontal and vertical segments 22, 24 of the housing 20. The spokes 74 are radially spaced and allow fluid flow therebetween. The horizontal and vertical links 58, 62 can include multiple linkages connected together in the manner illustrated in FIG. 2 wherein link 58' is comprised of more than one linkage 58*a*, 58*b* and the horizontal link 62 is comprised of more than one linkage 62*a*, 62*b*. Furthermore, as illustrated in FIG. 2, the adjustment mechanisms 60, 64 can be eliminated so long as the components are produced with sufficient tolerances to maintain the plug 32 in the sealed position.

Figure 11:
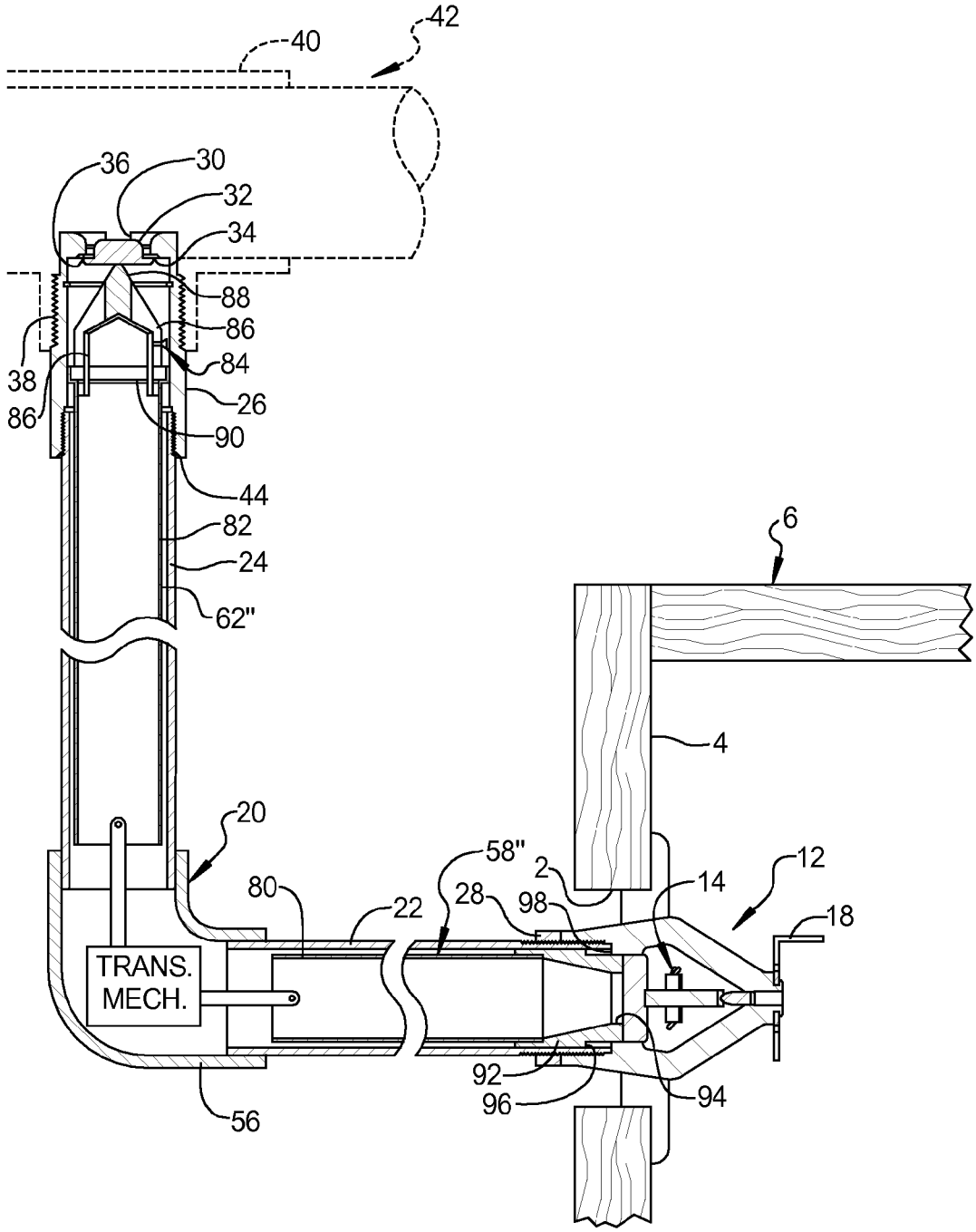
FIG. 11 is a cross-sectional view of a dry sprinkler assembly according to the principles of the present disclosure.

As a still further alternative, as illustrated in FIG. 11, the horizontal link 58" and the vertical link 62" can include hollow cylindrical or tubular members 80, 82 that serve as a link within the translation mechanism. The tubular sections 80, 82 can be utilized with each of the translation mechanisms described herein as an alternative to rod-shaped links or other linkages, as disclosed.

The vertical link 62 can include a seat support 84 as shown in FIG. 1 that can include 3 or more legs 86 that transfer the load from the link to the pointed tip 88 at the center of the support 84 to secure the plug 32 against the seal seat 36. The link 62 can be connected to the seat support 84 by a transverse pin 90, as shown, or alternatively, in the embodiment of FIG. 11, the tube portion 82 can engage the three or more legs 86 of the seat support 84.

Furthermore, as illustrated in FIG. 11, the hollow section 80 of horizontal link 58" can be connected to an outlet orifice member 92 which can include an outlet orifice 94 that defines the flow passage restriction for suppressant fluid passing therethrough. The outlet orifice member 92 can include a shoulder portion 96 which is spaced from a corresponding stop surface 98 that allows the outlet orifice member 92 to slide axially upon release of trigger 14 to allow the translation mechanism to disengage the plug 32 to release the plug 32 from the inlet opening 30. The axial movement of the outlet orifice member 92 is stopped by the stop surface 96 engaging the shoulder 98.

Figure 3:
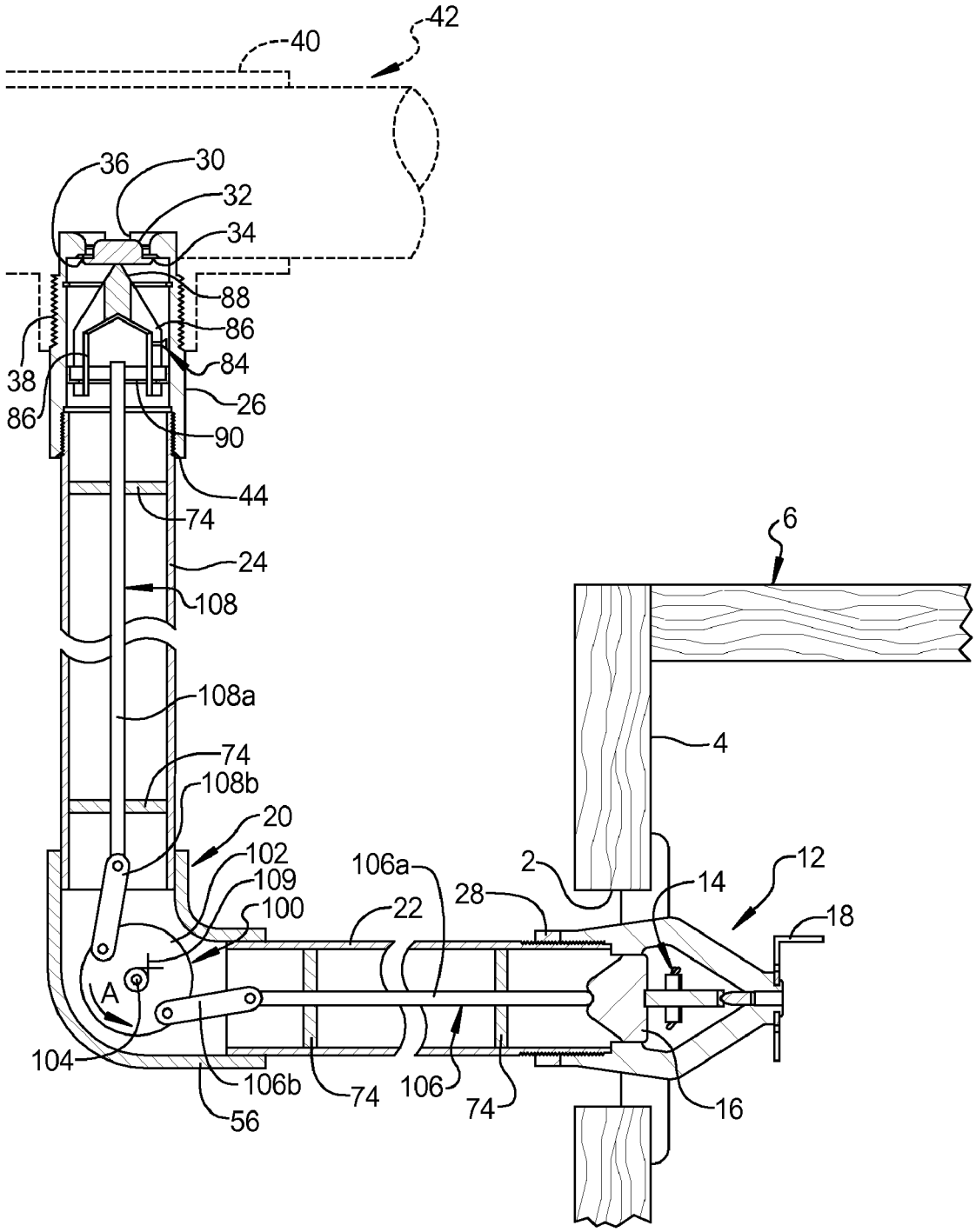
FIG. 3 is a cross-sectional view of a dry sprinkler assembly according to the principles of the present disclosure.

With reference to FIG. 3, a further alternative arrangement of the translation mechanism 100 will now be described. The translation mechanism 100 includes a pivot member such as a flywheel 102 mounted to a pivot shaft 104 and including a horizontal link 106 connected to the pivot member 102 and a vertical link 108 also connected to the pivot member 102. A torsion spring 109 is provided for biasing the pivot member in the direction of arrow A. The horizontal link 106 engages cap 16 while vertical link 108 engages plug 32 to support the plug 32 in the inlet opening 30. The horizontal link 106 can include multiple links 106*a*, 106*b* and the vertical link 108 can include multiple links 108*a*, 108*b*. It should be understood that the links 106, 108 can include hollow tubular members in the manner disclosed in FIG. 11.

Figure 4:
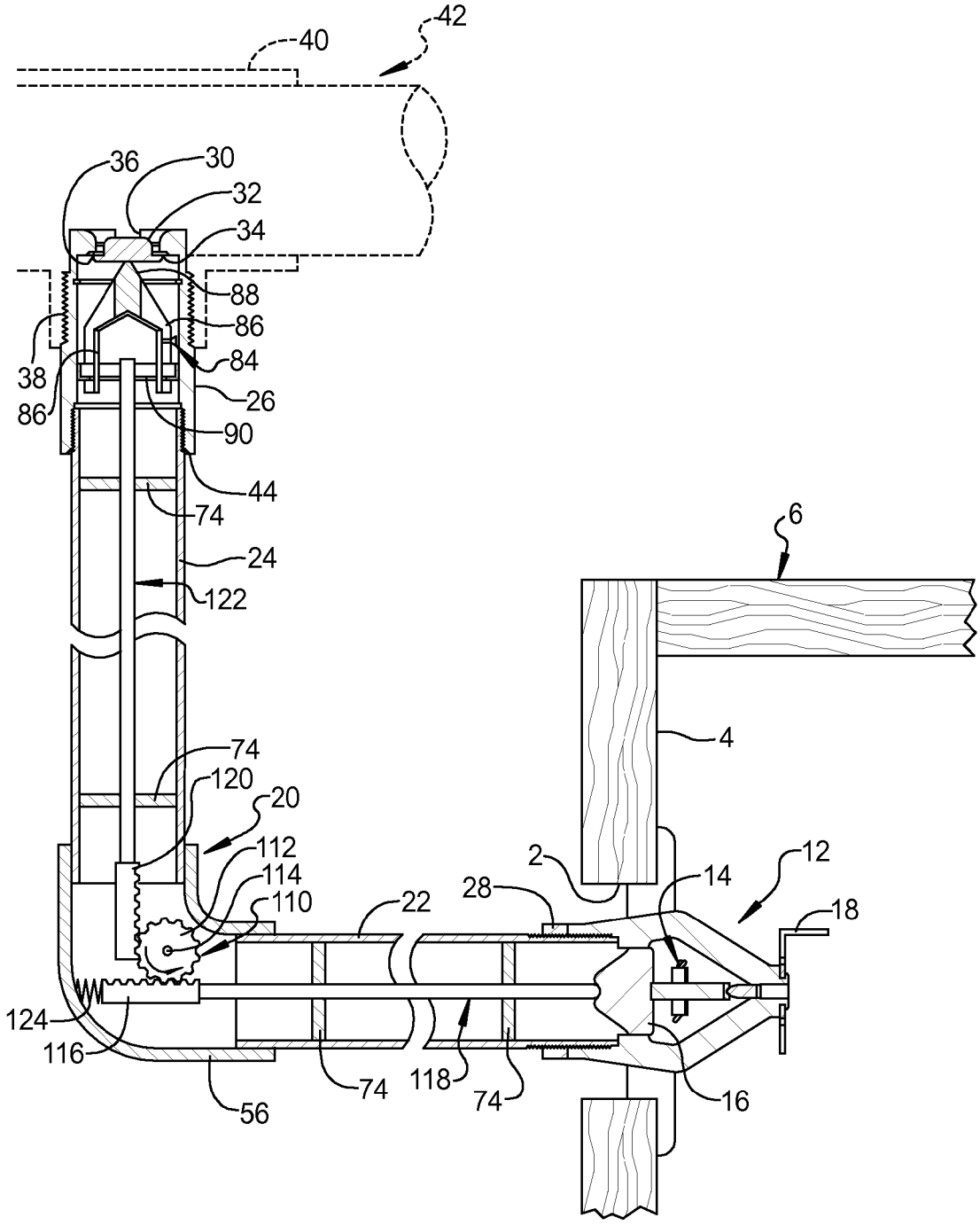
FIG. 4 is a cross-sectional view of a dry sprinkler assembly according to the principles of the present disclosure.

With reference to FIG. 4, an alternative translation mechanism 110 will now be described. The translation mechanism 110 can include a pinion gear 112 rotatably mounted to the housing 20 by an axle shaft 114 that can traverse the housing 20. A first rack 116 can be engaged with the pinion gear 112 and can be connected to a horizontal link 118 which engages the cap 16. A second rack 120 can also be engaged with the pinion gear 112 and can be attached to a vertical link 122 which supports the plug member 32 in the inlet opening 30. It should be understood that the links 118, 122 can be in the form of hollow tubes such as disclosed in FIG. 11. A spring member 124 can be utilized to bias the first rack 116 in the direction of the sprinkler body 12 which causes rotation of pinion gear 112 which causes second rack 120 to move downward thereby releasing the plug 32 from engagement with the inlet opening 30, thus allowing water to flow through the sprinkler assembly 12.

Figure 5:
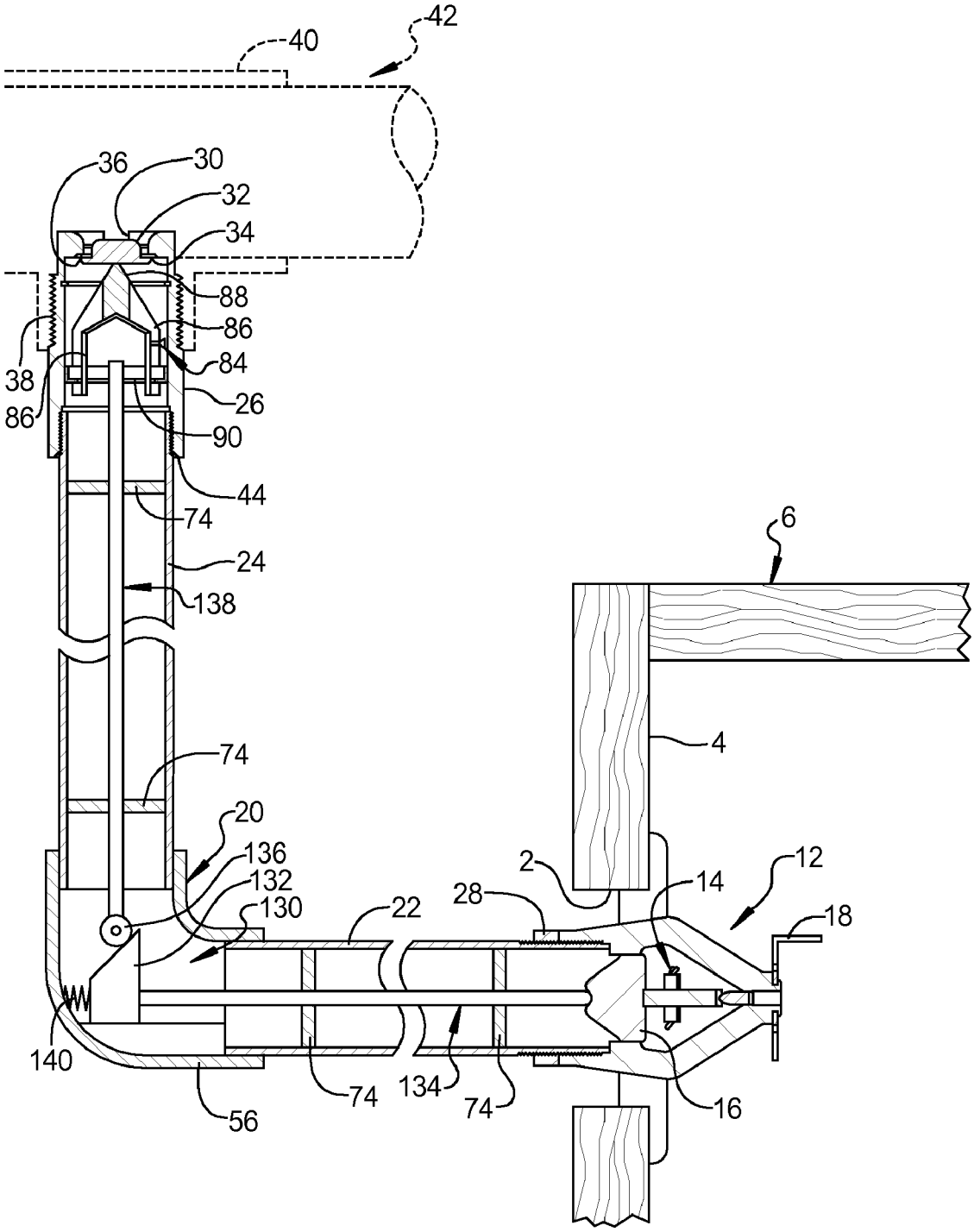
FIG. 5 is a cross-sectional view of a dry sprinkler assembly according to the principles of the present disclosure.

With reference to FIG. 5, an alternative translation mechanism 130 will now be described. The translation mechanism 130 includes a cam block 132 slidably supported within the housing 20. A horizontal link 134 is disposed between the cam block 132 and cap 16. A cam follower 136 is disposed against the cam 132 and is connected to a vertical link 138 which supports the plug member 32 in the inlet opening 30. A spring 140 biases the cam block 132 in the direction of the sprinkler body 12. When the trigger 114 is released, the spring 140 pushes cam 132 in the direction of sprinkler body 12. When the cam 132 moves toward the sprinkler body 12, the cam follower 136 is allowed to move vertically downward allowing the plug 32 to disengage the inlet opening 30 thereby allowing water to flow through the sprinkler assembly 12. It should be understood that the links 134, 138 can include hollow tubular members as shown in FIG. 11.

Figures 6, 7:
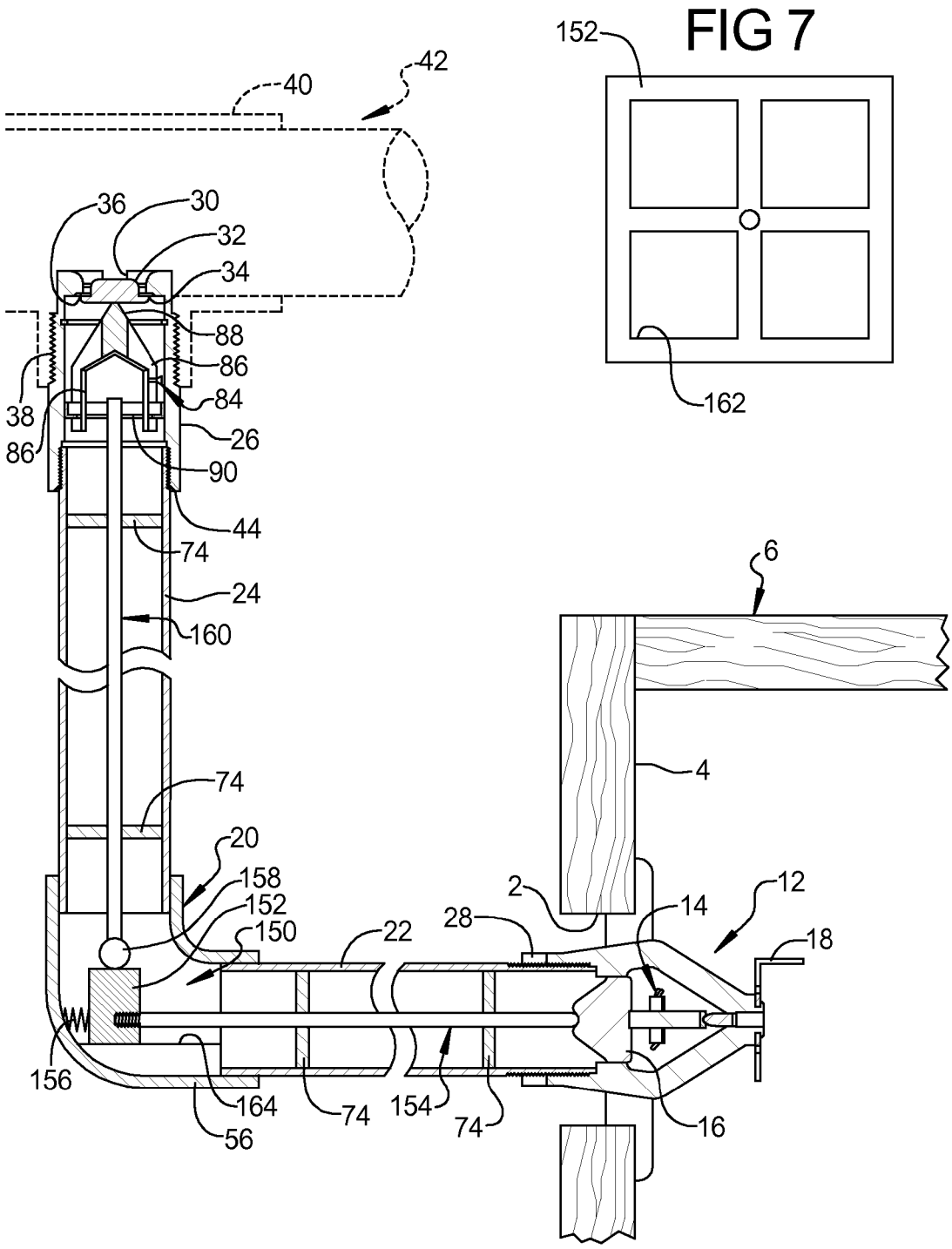
FIG. 6 is a cross-sectional view of a dry sprinkler assembly according to the principles of the present disclosure.
FIG. 7 is an end view of the slide block of the dry sprinkler shown in FIG. 6.

With reference to FIG. 6, an alternative translation mechanism 150 will now be described. The translation mechanism 150 can include a slide block 152 connected to a horizontal link 154 that engages cap 16. A spring 156 biases the slide block 152 in the direction of sprinkler body 12. A bearing 158 is supported on the top of the slide block 152 and engages a vertical link 160 that supports the plug 32 in the inlet opening 30. When the trigger mechanism 14 releases, the spring 156 biases the slide block 152 toward the sprinkler body 12 thus causing the bearing member 158 to disengage with the link 160, thereby allowing the plug 32 to disengage from the inlet opening 30 to allow water to flow through the sprinkler assembly. As illustrated in FIG. 7, the slide block 152 can include apertures 162 extending therethrough to allow water to flow through the slide block. Furthermore, the slide block 152 can be supported on a guide track 164 which can be lubricated to provide a low friction engagement with slide block 152. The horizontal and vertical links 154,160 can include hollow tubular members as shown in FIG. 11.

Figure 8:
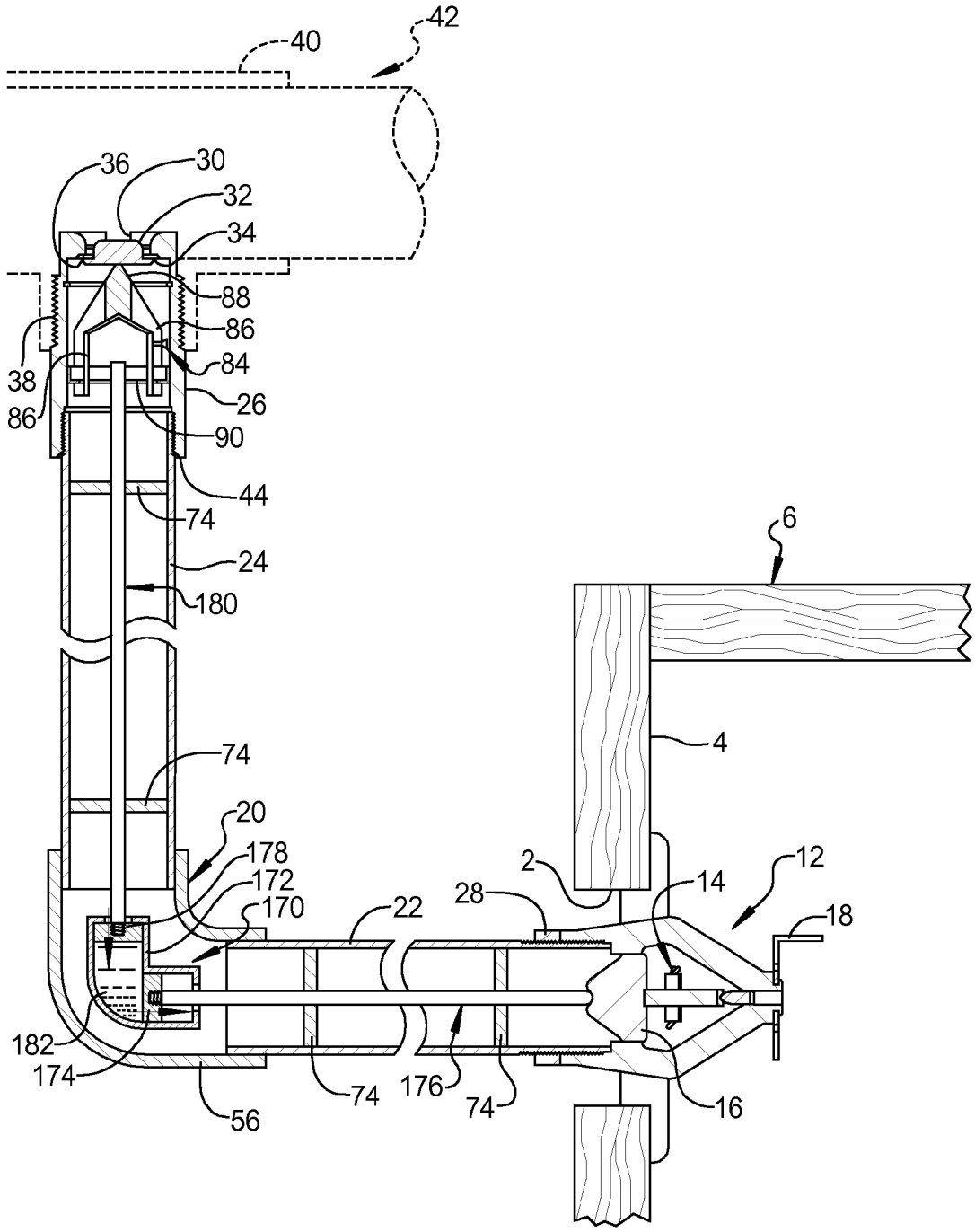
FIG. 8 is a cross-sectional view of a dry sprinkler assembly according to the principles of the present disclosure.

With reference to FIG. 8, an alternative translation mechanism 170 will now be described. The translation mechanism 170 includes a hydraulic chamber 172 that receives a first piston 174 that is connected to a horizontal link 176 that engages cap 16. A second piston 178 is disposed in hydraulic chamber 172 and is connected to a vertical link 180 that supports plug 32 in inlet opening 30. A hydraulic fluid 182 is disposed in the hydraulic chamber 172 and preferably has a freezing temperature below 32° F. As the trigger mechanism 14 is released, the pressure against plug member 32 forces vertical link 180 to cause piston 178 to push against the hydraulic fluid 182 which causes piston 174 to move towards sprinkler body 12, thereby allowing the plug member 32 to disengage from the inlet opening 30 to allow water to flow through the sprinkler assembly. It should be understood that the links 176, 180 can include tubular members as disclosed in FIG. 11.

Figure 9:
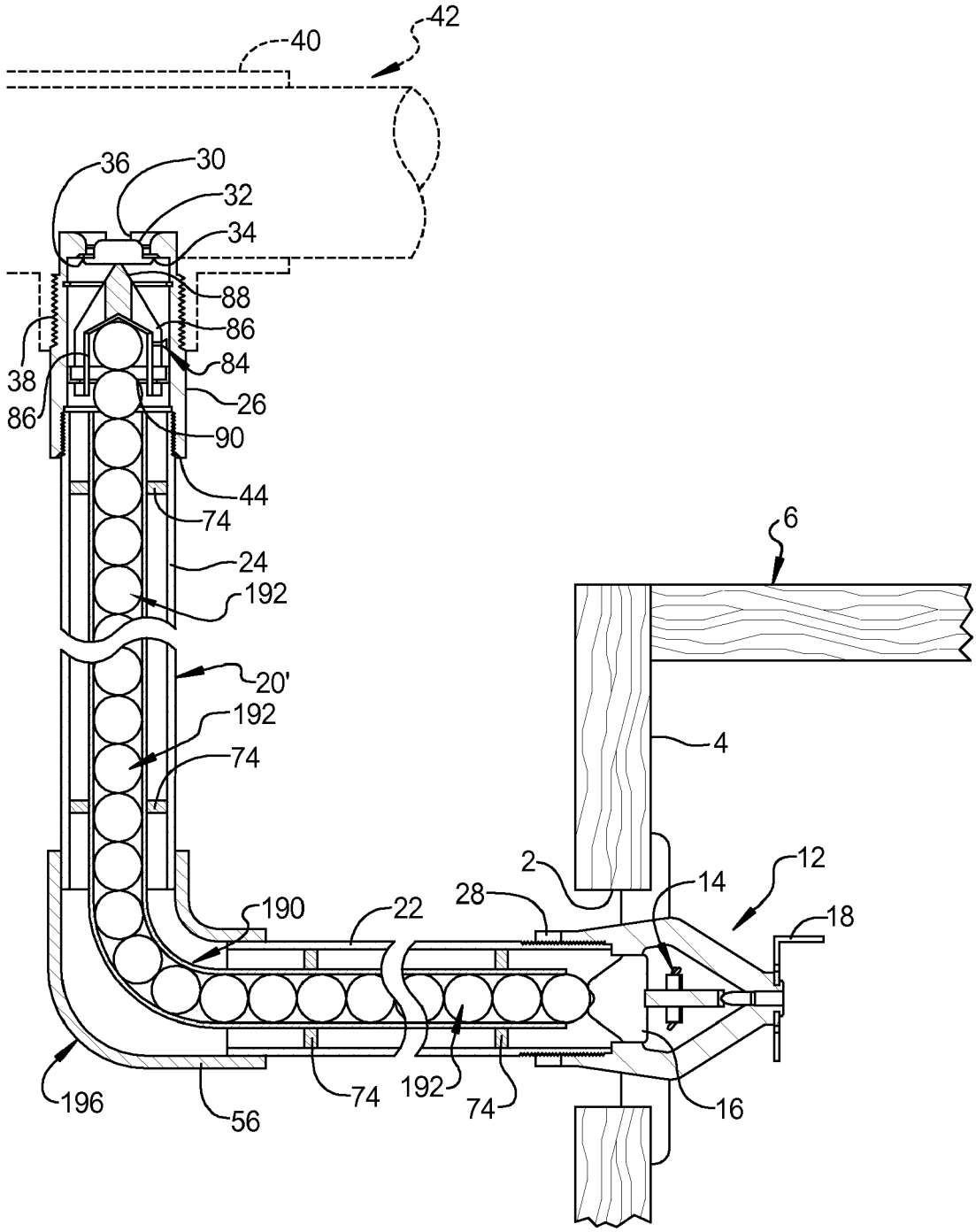
FIG. 9 is a cross-sectional view of a dry sprinkler assembly according to the principles of the present disclosure.

With reference to FIG. 9, an alternative translation mechanism 190 will now be described. The translation mechanism 190 includes a plurality of balls disposed side-by-side and extending through the housing 20' from the inlet opening 30 in the vertical segment 24 through the elbow/transition portion 196 and to the outlet opening in the horizontal segment 22 and disposed against cap 16. The elbow transition portion 196 can be sloped so as to prevent a jam of the balls within the passage. The balls 192 have a diameter smaller than the outlet opening, whereby upon release of the trigger mechanism 14, the balls are forced by the water pressure in the piping system through the outlet opening in the sprinkler body 12 to thereby allow water to flow through the sprinkler assembly. It is noted that the ball immediately adjacent to the inlet opening 30 can serve as a plug member for sealing the inlet opening 30 or alternatively, a plug 32 and plug support 84 can be disposed against one of the balls 192.

With reference to FIG. 10, an alternative translation mechanism 200 will now be described. The alternative translation mechanism 200 can include any one of the mechanisms disclosed in FIGS. 1-6 and 8, as discussed above, and the horizontal link 202 can include one or more balls 204 disposed against the cap 16. When the trigger 14 is released, the cap 16 is released from the sprinkler body 12 and the balls 204 are expelled through the outlet opening. The horizontal link 202 moves axially toward the sprinkler body 12 allowing the translation mechanism 200 to remove support for the plug 32 in the inlet opening 30. Thus, water is then allowed to flow through the sprinkler assembly. The link 202 can include spoke members 206 which can engage a stop surface 208 to retain the link 202 axially within the housing 20. Additionally, the horizontal and vertical links can include hollow tubular members 58", 62" in the manner disclosed in FIG. 11.

The dry sprinkler assembly of the present disclosure allows a horizontal dry sprinkler to be assembled as a sidewall sprinkler with easier assembly than current sidewall dry-type sprinklers.

What is claimed is:

1. A horizontal dry fire protection sprinkler, comprising:

a housing having a vertical segment connected to a horizontal segment extending generally perpendicular to said vertical segment, said vertical segment defining an inlet opening;

a plug member disposed in said inlet opening of said vertical segment for sealingly closing said inlet opening;

a sprinkler attached to said horizontal segment and including a base having a passage extending there through and defining an outlet opening, a cap disposed in said outlet opening and a heat sensitive trigger engaging said cap; and a translation mechanism disposed in said housing and engaging said cap and supporting said plug member in said inlet opening, wherein when said heat sensitive trigger releases support of said cap, said translation mechanism is allowed to move within said housing to allow said plug member to dislodge from said inlet opening.

2. The sprinkler according to claim 1, wherein said translation mechanism includes a pivot member pivotally supported by said housing and a first link engaging said pivot member and supporting said plug member in said inlet opening and a second link engaging said pivot member and said cap.

3. The sprinkler according to claim 2, further comprising a spring member biasing said pivot member toward said sprinkler.

4. The sprinkler according to claim 2, wherein said pivot member includes a first arm portion engaging said first link and a second arm portion engaging said second link.

5. The sprinkler according to claim 4, wherein said first arm portion adjustably supports a first threaded member and said second arm adjustably supports a second threaded member, said first threaded member engaging said first link and said second threaded member engaging said second link.

6. The sprinkler according to claim 5, wherein said housing includes at least one access port to allow adjustment of at least one of said first and second threaded members.

7. The sprinkler according to claim 2, wherein said first link includes a plurality of linkages.

8. The sprinkler according to claim 2, wherein said second link includes a plurality of linkages.

9. The sprinkler according to claim 1, wherein said translation mechanism includes a pinion gear rotatably mounted within said housing, a first rack member engaging said pinion gear and attached to a link that supports said plug member in said inlet opening and a second rack member engaging said pinion gear and attached to a link that engages said cap.

10. The sprinkler according to claim 1, wherein said translation mechanism includes a cam member attached to a first link that engages one of said cap and said plug member and a cam follower engaging said cam member and attached to a second link that engages the other of said cap and said plug member.

11. The sprinkler according to claim 10, further comprising a spring member biasing said cam member toward said outlet opening.

12. The sprinkler according to claim 1, wherein said translation mechanism includes a spring biased slide mechanism attached to a first link that engages said cap and a second link supporting said plug member in said inlet opening and engages said slide mechanism via an intermediate bearing member, wherein upon release of said heat sensitive trigger mechanism, said slide member is biased toward said outlet opening to cause said bearing member to disengage said second link and allow said plug member to dislodge from said inlet opening.

13. The sprinkler according to claim 1, wherein said translation mechanism includes a hydraulic chamber disposed in said pipe section and having a first piston disposed in said hydraulic chamber and a first link engaging said first piston and supporting said plug member in said inlet opening and a second piston disposed in said hydraulic chamber and a second link engaging said second piston and said cap.

14. The sprinkler according to claim 13, further comprising a fluid having a freezing temperature below 32 degrees Fahrenheit disposed in said hydraulic chamber between said first and second pistons.

15. The sprinkler according to claim 13, wherein said hydraulic fluid chamber is disposed in an elbow portion of said housing.

16. The sprinkler according to claim 1, wherein said translation mechanism includes a plurality of balls disposed side by side in said housing and extending between said cap and said plug member for supporting said plug member in said inlet opening.

17. The sprinkler according to claim 16, wherein said plurality of balls have a diameter smaller than a diameter of said outlet opening.

18. The sprinkler according to claim 1, wherein said translation mechanism includes a plurality of balls disposed side by side in said housing, said balls having a diameter smaller than a diameter of said outlet opening.

19. The sprinkler according to claim 1, wherein said translation mechanism includes at least one ball disposed in an outlet end of said housing, said at least one ball having a diameter smaller than a diameter of said outlet opening.

20. A horizontal dry fire protection sprinkler, comprising:

a housing having a vertical segment and a horizontal segment extending generally perpendicular to said vertical segment, said vertical segment defining an inlet opening;

a plug member disposed in said inlet opening for sealingly closing said inlet opening;

a sprinkler attached to said horizontal segment and including a base having a passage extending there through and defining an outlet opening, a cap disposed in said outlet opening and a heat sensitive trigger engaging said cap; and a translation mechanism disposed in said housing and engaging said cap and supporting said plug member in said inlet opening, wherein when said heat sensitive trigger releases support of said cap, said translation mechanism is allowed to move within said housing to allow said plug member to dislodge from said inlet opening;

wherein said housing includes an elbow segment attached to said vertical segment and said horizontal segment.

21. A horizontal dry fire protection sprinkler, comprising:

a housing having a vertical segment and a horizontal segment extending generally perpendicular to said vertical segment, said vertical segment defining an inlet opening;

a plug member disposed in said inlet opening of said vertical segment for sealingly closing said inlet opening;

a sprinkler attached to said horizontal segment and including a base having a passage extending therethrough and defining an outlet opening, a cap disposed in said outlet opening and a heat sensitive trigger engaging said cap; and means for supporting said plug member in said outlet opening and releasing said plug member from said inlet opening upon said heat sensitive trigger being released from engaging said cap.

* * * * *